US007021488B2

(12) United States Patent
Thompson

(10) Patent No.: US 7,021,488 B2
(45) Date of Patent: Apr. 4, 2006

(54) PRESSURE VESSEL FOR COMPRESSED GASES UTILIZING A REPLACEABLE AND FLEXIBLE LINER

(75) Inventor: Scott R. Thompson, Houston, TX (US)

(73) Assignee: Matheson Tri-Gas, Inc., Longmont, CO (US)

( * ) Notice: Subject to any disclaimer, the term of this patent is extended or adjusted under 35 U.S.C. 154(b) by 12 days.

(21) Appl. No.: 10/403,309

(22) Filed: Mar. 31, 2003

(65) Prior Publication Data

US 2004/0188449 A1 Sep. 30, 2004

(51) Int. Cl.
*B65D 25/14* (2006.01)

(52) U.S. Cl. ..... 220/586; 220/495.06; 220/581; 220/723

(58) Field of Classification Search ..... 220/581–592, 220/495.03, 495.06, 723
See application file for complete search history.

(56) References Cited

U.S. PATENT DOCUMENTS 2,321,836 A * 6/1943 Marzo ..... 220/495.03
3,211,348 A * 10/1965 Greer ..... 222/386.5
3,213,913 A * 10/1965 Petriello ..... 220/723
3,258,147 A * 6/1966 Rownd ..... 215/12.1
3,907,149 A * 9/1975 Harmon ..... 220/590
3,917,115 A * 11/1975 Travers et al. ..... 222/3
4,211,825 A * 7/1980 Shipman ..... 428/483
4,293,353 A * 10/1981 Pelton et al. ..... 220/495.06
4,796,788 A * 1/1989 Bond ..... 222/94
4,817,830 A * 4/1989 Yavorsky ..... 222/386.5
5,127,399 A 7/1992 Scholley
5,150,741 A 9/1992 Valy et al.
5,368,067 A 11/1994 Cook, Jr.
5,368,195 A 11/1994 Pleet et al.
5,551,590 A * 9/1996 Mazur et al. ..... 220/495.05
5,636,760 A * 6/1997 Yamamoto et al. ..... 229/164.2
5,934,500 A * 8/1999 Cogger et al. ..... 220/495.06
5,954,222 A 9/1999 White et al.
6,068,152 A * 5/2000 Meiners et al. ..... 220/1.6
6,089,399 A 7/2000 Felbaum et al.
6,145,692 A 11/2000 Cherevatsky
6,186,356 B1 2/2001 Berkley et al.
6,230,922 B1 5/2001 Rasche et al.
6,761,286 B1 * 7/2004 Py et al. ..... 222/105

* cited by examiner

*Primary Examiner*—Gary E. Elkins
(74) *Attorney, Agent, or Firm*—Kent A. Lembke; Hogan & Hartson L.L.P.

(57) ABSTRACT

A pressure vessel assembly, and method of use, for storing a gas at an elevated pressure. The assembly includes a vessel body having a rigid wall with an inner surface defining a storage chamber and with an inlet allowing the gas to enter the storage chamber. The assembly includes a flexible liner positioned within the storage chamber to be in fluid communication with the inlet to receive any fluid entering the vessel body. The liner is formed of an elastic inner layer contacting the gas and a metallic outer surface. The inflated, unrestrained liner volume is generally at least as large as the chamber volume and more typically, slightly larger. Stored gas contacts the inner surface of the liner and expands the liner from a smaller deflated volume until the outer surface of the liner contacts the wall of the pressure vessel.

7 Claims, 4 Drawing Sheets

PRESSURE VESSEL FOR COMPRESSED GASES UTILIZING A REPLACEABLE AND FLEXIBLE LINER

BACKGROUND OF THE INVENTION

1. Field of the Invention

The present invention relates generally to the field of compressed fluids and pressure vessels for compressed fluids, and more particularly, to a pressure vessel, and method of using same, with a flexible or inflatable liner that can be inserted within the vessel body for providing a hermetic barrier between inner surfaces of the vessel body and stored gases and that can later be removed to facilitate reuse of the pressure vessel.

2. Relevant Background

For many years, pressure vessels have been used for storing gases for scientific and industrial uses. A well-known example of such a pressure vessel is the cylinders used for storing compressed gases, such as helium, oxygen, nitrogen, and other gases. These compressed gas cylinders or pressure vessels typically have a body that is about a foot in diameter and four to five feet long with a flattened bottom and a reduced top end or neck that has a valve screwed into inner threads to provide a hermetic seal. The pressure vessel bodies are ordinarily constructed of metal, such as carbon steel, to economically achieve the high strengths needed to contain gases at higher pressures, e.g., in the range of 2000 to 5000 pounds per square inch.

While the use of pressure vessels for storing gas is well known, there is a growing and continuing need for improvements in safely, inexpensively, and effectively storing gases while retaining gas purities. Scientific, medical, and manufacturing processes increasingly require very pure gases to be stored and later delivered according to stringent specifications. For example, in the ultra-high technology production processes for making computer chips where the transistor size is on the order of microns, the specifications on gas purity are extremely demanding.

Gas purity is often degraded when the stored gas directly contacts the interior surfaces of the vessel or container body as contaminants on interior surfaces mix with the gas. This contamination problem can be exasperated by surface imperfections on the inner surfaces of the vessel body. The gas purity may also be degraded if the stored gas is not compatible with the material or metal used for fabricating the vessel body. In these situations, purity is degraded by the release of contaminants produced in chemical reactions occurring between the body of the pressure vessel and the stored gas. In an attempt to control contamination, a pressure vessel may be internally polished at original manufacture and during periodic maintenance and is typically cleaned, e.g., steam cleaning, pressure cleaning, chemical cleaning, and the like, according to exacting standards. While these techniques may provide useful control over contaminants these processes are labor and equipment intensive and are often costly. Further, the pressure vessel may need to be cleaned again prior to reuse or even polished based on the age of the vessel, and these techniques do not address the issue of material incompatibility between stored gases and vessel body materials. In many cases, a pressure vessel simply cannot be used for other gases after it has been used for a gas that is incompatible with the proposed new gas, which severely limits the recycling or continued use of existing pressure vessels or compressed gas cylinders.

Pressure vessels, such as compressed gas cylinders, with rigid liners made of corrosion-resistant metal plating (such as nickel plating), glass, ceramic, plastic, or other material have been developed in an attempt to reduce control gas purity degradation and to minimize material compatibility problems. While such rigidly lined vessels are much more effective at providing consistently pure gas, there are a number of issues that arise from using lined pressure vessels. Lined pressure vessels are often very expensive to fabricate. For example, metal plated or lined vessels are typically produced using an electroplating process with a relatively expensive corrosion-resistant metal, and the use of ceramic or other material liners typically requires baking, e.g., vacuum baking, the entire vessel. Post-production steps generally include polishing and/or extensive cleaning of all interior surfaces. Alternatively, the manufacturing may be performed entirely or partially in a clean room or clean environment. Clearly, the manufacture of lined pressure vessels is more expensive in labor, material, and equipment costs than standard unlined pressure vessels.

There are also service problems with using rigidly lined pressure vessels for storing compressed gases. For example, there are often problems obtaining an adequate seal between the neck and the valve due to the difficulty in cutting threads in liners and efforts continue to provide an effective solution to this sealing problem. Another problem is that the surface of the liner itself can have irregularities and high surface roughness, such as due to electroplating processes, that can trap contaminants that could later be released degrading the purity of stored gas. Pressure vessels with rigid liners, such as metal-plated cylinders, have also proven to have limited durability, especially during rigorous retesting procedures and during service conditions that may create differing expansions in the liner and the adjacent vessel body or that applies large internal pressures mainly on the liner. This has led to a shortened service life as once flaws in the liner develop the pressure vessel is typically not repaired but is instead taken out of service.

Hence, there remains a need for an improved pressure vessel that maintains the purity of stored gases and addresses the problem of material incompatibility with stored gases and inners surfaces of vessel bodies and with stored gases and previously stored gases. Preferably, such an improved pressure vessel would be cost effective to manufacture, to use, and to maintain, and would be compatible with existing systems that utilize pressure vessels, such as compressed gas cylinders, and with the existing pressure vessel fleet, e.g., provide a technique for continued use of previously manufactured and in-use vessels. Further, it is desirable that such pressure vessels comply with existing and future regulations covering storage of compressed gases, such as those issued in the United States by the Department of Transportation (DOT).

SUMMARY OF THE INVENTION

The present invention addresses the above problems by providing a pressure vessel assembly that utilizes a flexible liner or inflatable insert to provide a hermetic seal between stored gas and inner surfaces of the pressure vessel body to control contamination of the contained gas and to eliminate a number of time consuming and costly manufacturing and maintenance procedures (such as installing a rigid liner, polishing a liner or inner surfaces of a vessel body, and cleaning inner surfaces). The flexible liner is typically fabricated in a clean room (to minimize later cleaning steps) and is formed of a flexible material. In some embodiments, the flexible liners are shaped to mate with the interior of the vessel body but are sized to have an inflated volume larger than the volume of the vessel body. In other words, the liner has an inflated volume in the unrestrained state that is larger than the interior volume of the vessel.

The liner is inserted within the vessel body in a deflated state, and when the vessel is charged with compressed gas, the liner expands until it contacts the inner surfaces of the vessel body at which point the vessel body prevents the liner from further expansion (i.e., prevents the liner from expanding to its unrestrained volume and prevents tensile stress failure in the liner). The vessel body provides the structural strength to contain the pressurized gas while the flexible insert provides a hermetic seal between the gas and the inner surfaces of the vessel controlling material compatibility problems and controlling degradation of gas purity. A number of materials may be used for the flexible liner and in one embodiment, the liner is a foil balloon with a metal outer layer, e.g., aluminum or other metal, provided over an inner layer of flexible material, such as nylon and/or polyethylene, with the metal other layer provided to improve gas permeability of the liner.

More particularly, a pressure vessel assembly is provided for storing a fluid, such as gas at an elevated pressure. The assembly includes a vessel body having a rigid wall with an inner surface that defines a gas storage chamber. The vessel body also includes an inlet, such as a threaded opening in a neck of gas cylinder, for allowing the fluid to enter the storage chamber. The assembly also includes a liner formed of one or more layers of flexible material. The liner is positioned within the storage chamber to be in fluid communication with the inlet to receive any fluid entering the vessel body. The liner is typically formed of a flexible inner layer defining an inner surface that contacts the stored fluid and a metallic outer layer defining an outer surface. Further, the inner surface of the liner is contiguous and defines a variable volume of the liner, with a deflated liner volume being less than the chamber volume and an inflated, unrestrained liner volume being at least as large as the chamber volume and more preferably, slightly larger. The received fluid contacts the inner surface of the liner and expands the liner from the deflated volume until the outer surface of the liner is in substantially continuous contact with the inner surface of the chamber, at which point the rigid walls provide the structural strength for containing the fluid.

According to another aspect of the invention, a method is provided for storing compressed gas. The method includes choosing a gas to store in a container (and storage parameters such as pressure and volume of gas) and then selecting a container or pressure vessel (e.g., a compressed gas cylinder) that is designed for those storage requirements (such as to contain a certain volume at a certain pressure and temperature and/or configured according to particular government or other storage and/or transportation regulations or requirements). The pressure vessel may be newly manufactured or may be a previously used pressure vessel that is lined or unlined and that was used for the same or a different (and even incompatible) gas. The method continues with selecting a flexible liner or liner insert for use with the particular gas and with the particular container. For example, the liner may be selected with a layer (such as a metallic foil layer) that has low permeability characteristics for the particular gas and with an elastic inner layer that is compatible with the gas. Further, the insert is preferably selected to have an external shape when inflated that is similar to the interior space or inner chamber of the pressure vessel but that has slightly larger dimensions such that the unrestrained, inflated volume of the liner is equal to or greater than the volume of the pressure vessel inner chamber.

The method includes inserting the liner into the inner chamber in a deflated state (or at least with the liner volume being less than the volume of the inner chamber). In some embodiments, the liner is fabricated in a clean room environment to achieve a desired interior surface roughness and to minimize impurities on the inner surfaces, and further, the insert is provided in an evacuated state (or such evacuation is included as a step in the method). The liner is typically connected to the neck or other inlet of the pressure vessel and then, a valve is connected to the neck or other inlet so as to obtain a seal between the pressure vessel, the valve, and the liner (such as with a stem of the liner disposed between the valve and the neck) and so that gas passing through the valve is directed into the liner. The method continues with connecting a gas supply for the particular gas to be stored to the valve and operating the source and valve to pump gas into the liner. The gas presses against the inner surface of the liner causing the liner to expand (i.e., increasing its volume) until the outer surface of the liner contacts the inner surface of the pressure vessel. At this point, the pressure vessel acts to restrain further expansion and to provide the structural strength for containing the higher pressure gas. The method continues with disconnecting the gas source and then discharging the stored gas from the pressure vessel and liner. Next, if the liner is to be reused (such as when the same gas is to be stored in the pressure vessel, the steps of connecting the gas source and operating the source and valve are repeated. If the liner is to be replaced but vessel reused, the method continues with removing the liner, and repeating the steps of selecting a gas, selecting a compatible liner, inserting the liner (after removing the valve), sealing the vessel with the valve and liner, providing another gas source, and operating the gas source and valve to fill the vessel with the different gas.

DETAILED DESCRIPTION OF THE PREFERRED EMBODIMENTS

The present invention is directed toward a pressure vessel assembly, and method of using same, that is adapted with a flexible liner or insert to provide a replaceable and, in some cases, reusable sealing surface between a compressed gas and an inner surface of a vessel body. The vessel body provides the structural strength to contain the pressurized gas and also defines the inner shape of the vessel and its shape as the liner is preferably oversized, i.e., provided for the particular vessel with an unrestrained inflated volume and shape that is at least as large as the interior of the vessel and more preferably larger than the interior of the vessel. In this manner, the permeability of the liner material is improved because the liner material is not significantly stretched and is not subject to tensile stress and potential structural failure associated with rigid vessel liners subjected to high pressures.

Figure 3:
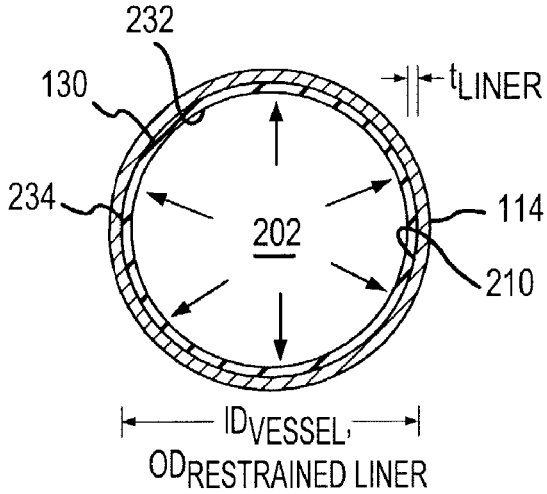
FIG. 3 is a sectional view of the vessel of FIG. 2 taken at line 3—3 illustrating that the inner surfaces of the vessel body walls provide structural support for the flexible liner to resist outward forces produced by the contained gas such that the inner diameter (or other dimensions) of the vessel body defines the outer diameter (or other dimensions and shapes) of the flexible liner.
Figure 4:
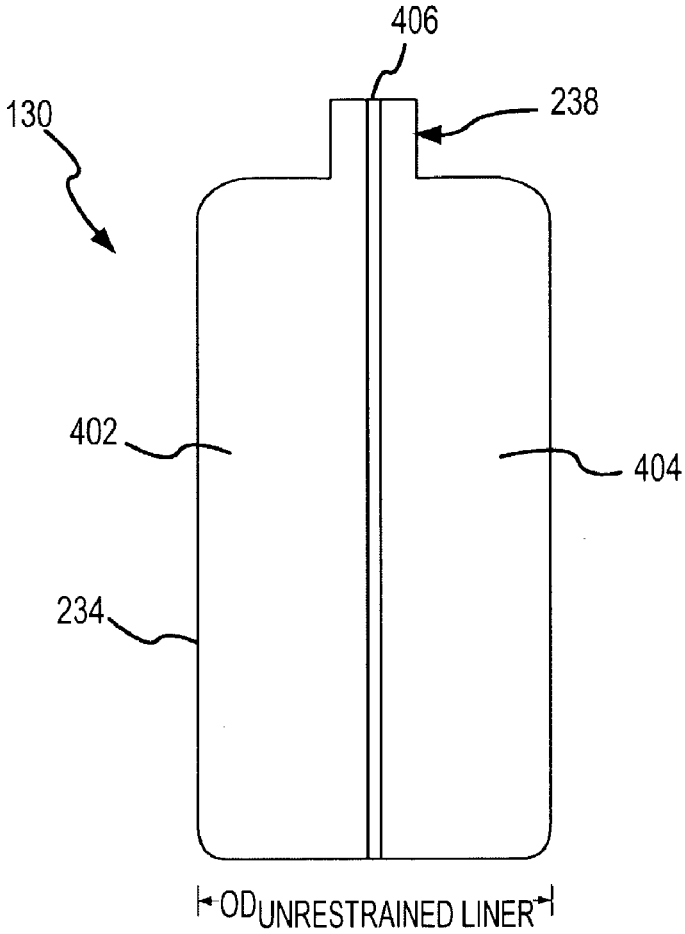
FIG. 4 is a side view of the liner of FIGS. 1–3 as it would appear if inflated outside of the vessel, i.e., in an unrestrained state, to illustrate construction of the liner and, more significantly, to illustrate that the outer diameter of the flexible liner when inflated in an unrestrained state or manner is larger (or at least equivalent) to the inner diameter of the vessel body.
Figure 5:
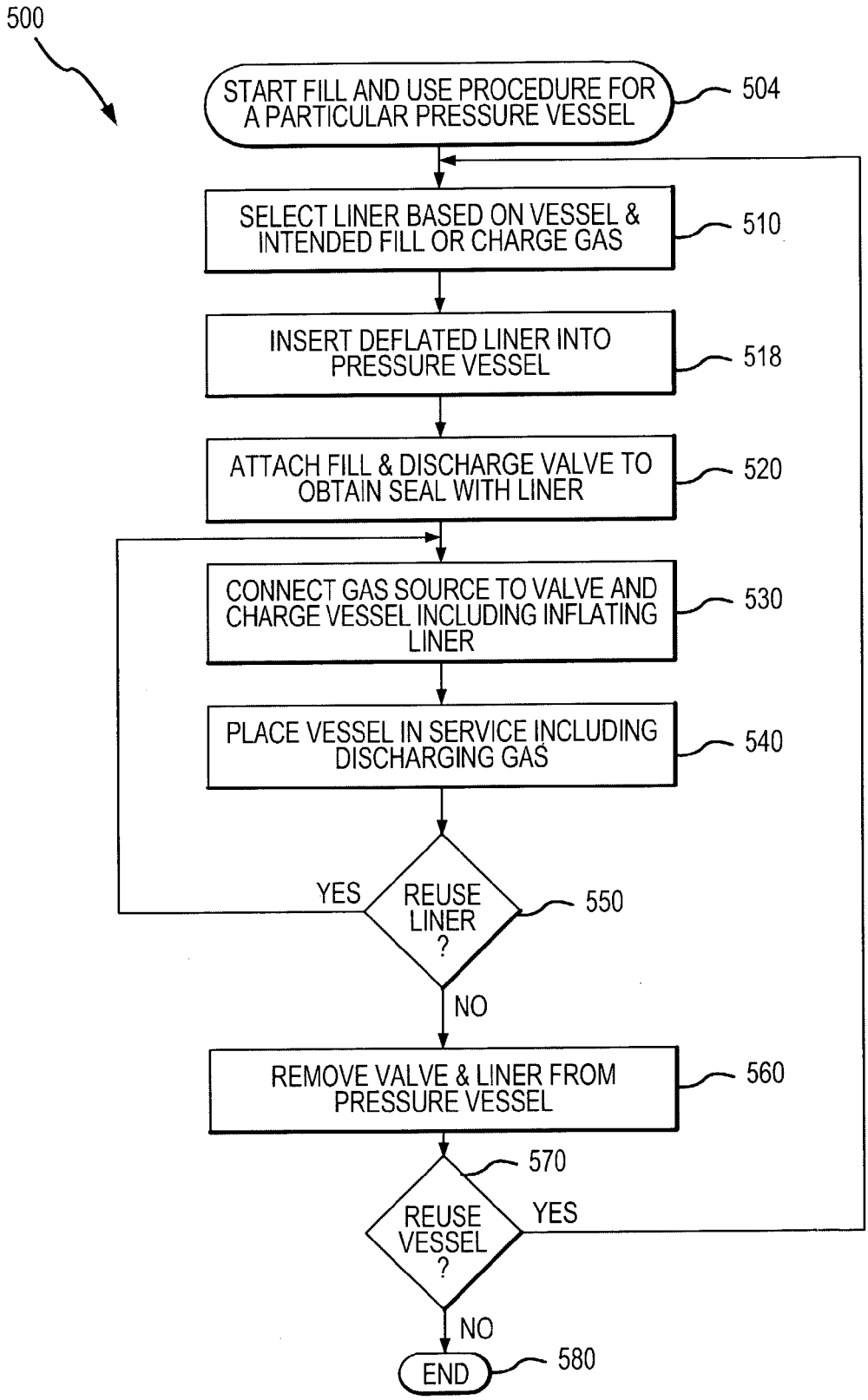
FIG. 5 is flow chart providing exemplary process steps for the process of assembling a pressure vessel assembly according to the invention and of charging, using, and, in some cases, reusing the liner and/or vessel.

The following description begins with a description of a pressure vessel assembly utilizing a flexible liner according to the invention with reference to FIGS. 1–4 and then, with reference to FIG. 5, continues with a description of a useful process of fabricating pressure vessel assemblies, filling or charging such vessels, and then using and reusing such vessels with or without replacement of the flexible liner. The description discusses the use of flexible liners with compressed gas cylinders as these are one of the more common types of pressure vessels used for storing and dispensing compressed gas, but it will be readily apparent from the following description that the invention is broad enough to cover the use of flexible liners with numerous vessel body shapes and volumes, with a wide range of compressed gases (or other fluids), and with a variety of liner materials and thickness.

Figure 1:
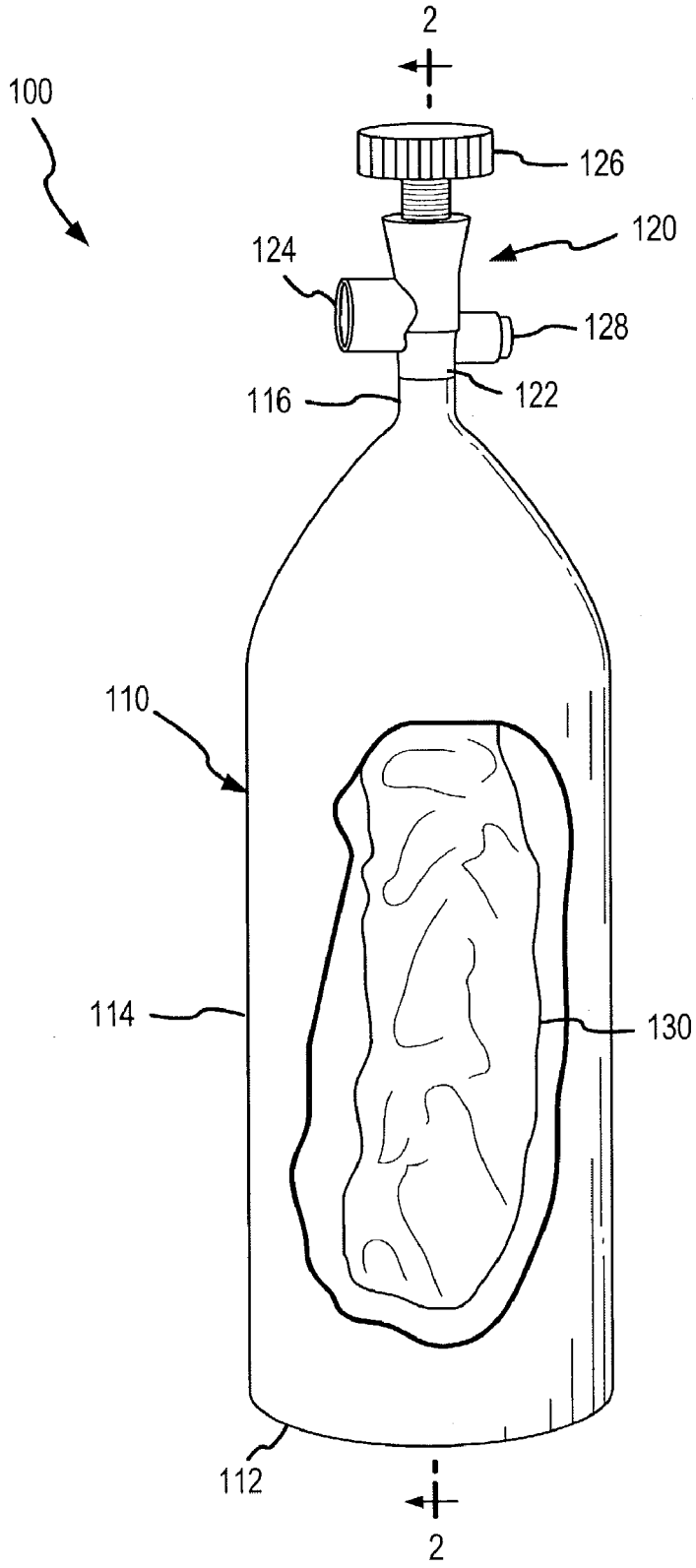
FIG. 1 is a perspective view of a pressure vessel assembly, i.e., an assembled compressed gas cylinder, according to the invention with a cutaway showing a flexible liner that has been installed in the vessel prior to charging of the vessel with a gas.

In FIG. 1, a pressure vessel assembly 100 is shown assembled according to the present invention. The assembly 100, e.g., a modified compressed gas cylinder, includes a vessel body 110, a fill and discharge valve 120, and a flexible liner 130 inserted into the vessel body 110. The flexible liner 130 is shown deflated, e.g., not inflated, as it would be upon initial insertion or upon discharging most or all of a compressed gas. In this deflated or initial state, the liner 130 is much smaller in size and/or volume than the interior space of the vessel body 110 and, thus, can readily be positioned within the vessel body 110. As is discussed below in detail, the liner 130 is an inflatable liner that provides a variable-volume sealing element for the assembly 100. To this end, the flexible liner 130 is preferably sized to have an inflated volume when unrestrained that is greater (or at least as great as) than the interior volume of the vessel body 110.

The vessel body 110 includes a flat bottom or end plate 112, a continuous side wall 114, and a reduced portion or neck 116, which is adapted for mating with the valve 120, such as with a female threaded fitting. The vessel body 110 is preferably configured for providing structural strength for containing a pressurized gas. The gas may be any gas that is stored in a compressed state for later use and, more typically, a gas for which high purity requirements are applied, such as helium, nitrogen, oxygen, and the like. To provide this strength, the vessel body 110 is often fabricated from a metal, such as carbon steel, with the thickness and material makeup of the vessel body 110 varying to suit the pressure rating of the vessel 100. The shape and size (i.e., the interior volume) of the vessel body 110 may vary widely to practice the invention as may the pressure rating of the vessel 100. As shown, the vessel body 110 may be cylindrical as found in commonly used compressed gas cylinders. Common sizes are about 4 to 12 inches in diameter and 1 to 5 feet in height and these vessels 100 are often configured to withstand internal pressures of 2000 PSI or higher. The walls 114 may be untreated or may be lined with a rigid liner (not shown), such as when the assembly 100 is fabricated from recycled or previously used vessel bodies 110, with the flexible liner 130 mating contiguously with the inner surface of the liner including filling any deformities such as surface pits, cracks, and the like caused by wear or developed during manufacture of the rigid liner. When the assembly 100 is fabricated with new vessel bodies 110, the walls 114 as shown typically are not lined with a rigid liner as such a liner is not required to control gas purity when the flexible liner 130 is provided in the assembly 100.

A fill and discharge valve 120 is included in the assembly 100. The valve 120 may take nearly any form that is useful for obtaining a seal with the neck 116 and liner 130 (as explained with reference to FIG. 2). The valve 120 is also preferably adapted for connecting with a gas source (not shown) for filling or charging the vessel 100 and for controlling filling and discharging of a compressed gas. The illustrated embodiment of the valve 120 includes a threaded male fitting 122 for insertion into the neck 116 of the vessel body 110 to obtain an acceptable seal to block leaking of a gas stored in the vessel 100. A connection fitting 124 is provided for connecting to gas supply lines during fill operations and to discharge lines during use of the vessel assembly 100. A knob 126 is included to allow manual opening and closing of the valve 120 and a pressure relief cock 128 is included for venting gas and in some cases protecting against over pressurization of the assembly 100.

Figure 2:
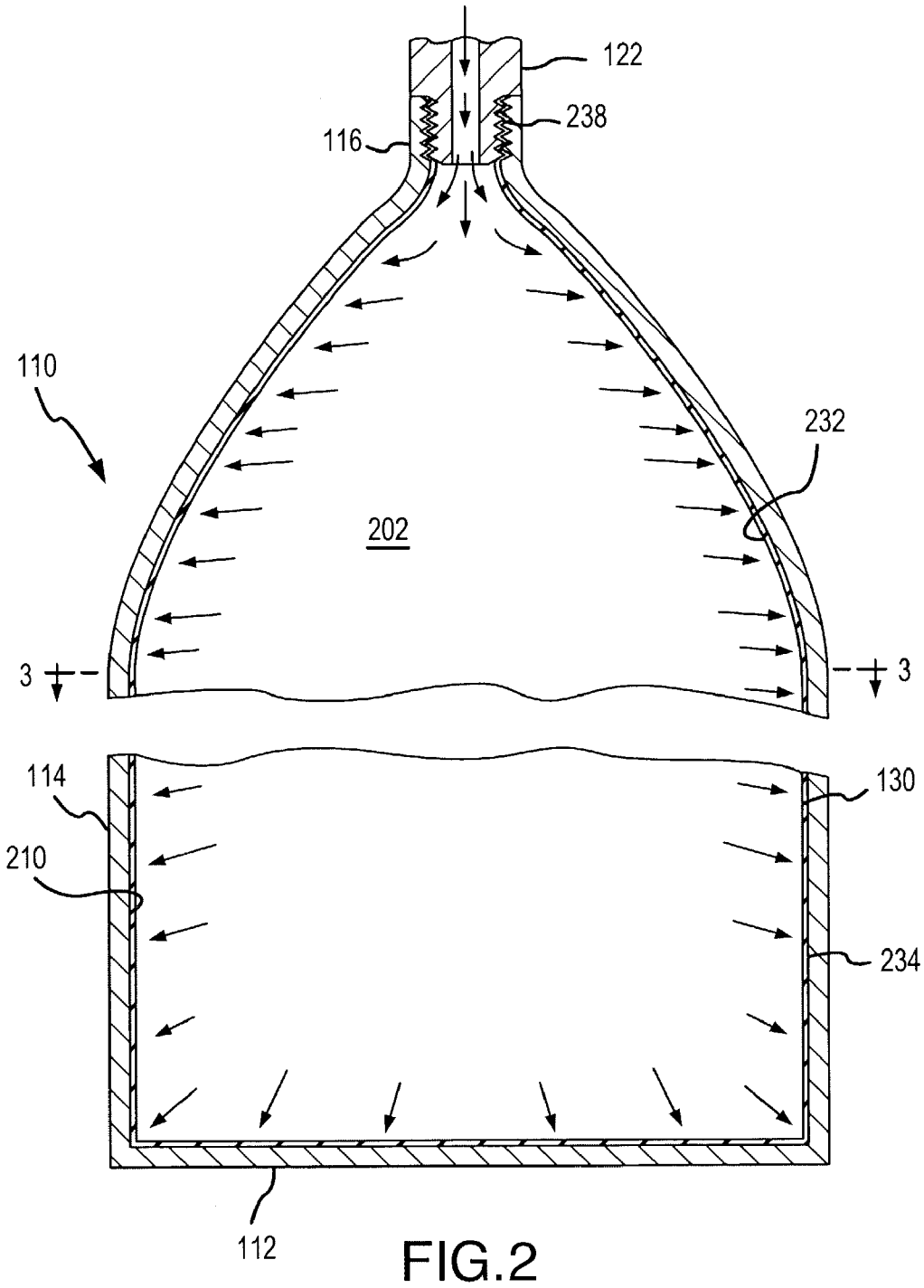
FIG. 2 is a sectional view of the vessel of FIG. 1 taken at line 2—2 as charging of the vessel is nearly complete illustrating the seal provided between the contained gas and the inner surfaces of the vessel body by the inflated, flexible liner and one embodiment of a seal obtained between the neck of the vessel body, the male, threaded fitting of fill and discharge valve, and the stem portion of the liner inserted therebetween.

FIG. 2 illustrates a cross section of the assembly 100 after filling has been completed or nearly completed. Gas 202 from a gas supply or source (not shown) connected to the valve 120 is forced via the male fitting 122 and neck 116 into the flexible liner 130. The gas 202 becomes quickly pressurized or reaches elevated pressures within the vessel body 110 and pushes outward against the inner surface 232 of the flexible liner 130 causing the flexible liner 130 to inflate and expand. The flexible liner 130 continues to expand outward until its outer surface 234 contacts the inner surface(s) of the vessel body 110. Initially such contact may be in only portions of the vessel body 110 but as more and more gas 202 is added and the pressure within the vessel body 110 increases, the contact between the outer surface 234 of the liner 130 and the inner surface 210 of the vessel body 110 becomes substantially contiguous. At this point, the vessel body 110, i.e., the inner surfaces 210 of the bottom plate 112, wall 114 and neck 116, restrain the liner 130 from further expansion and provide the necessary mechanical strength for containing the gas 202 under high pressures.

Depending on the material used for the liner 130, the liner 130 may become at least partially compressed or reduced in thickness or less stretched. This compression of the liner 130 material is useful for providing a less gas permeable liner 130, which may allow the liner 130 to be fabricated from materials that would be unacceptably permeable to gas during unrestrained conditions such as plastic sheeting, latex, and the like without an additional foil later being added to control gas seeping. Additionally, purity is at least partially controlled by providing the flexible liner 130 because the liner 130 acts as a filter blocking contaminants from the inner surfaces 210 from leaching into the gas. In other words, even in cases where the liner 130 is partially permeable to gas 202 degradation of the gas 202 is reduced by the liner 130 capturing or blocking movement of the contaminants into the gas 202. However, in most embodiments, the liner 130 is selected to be a material that is compatible with the gas 202 and is configured to be substantially impermeable to the gas 202, such as by the inclusion of a metal foil later on outer surface 234.

Also as shown in FIG. 2, a seal is provided in the assembly 100 at the connection point between the valve male fitting 122 and the neck 116 of the vessel body 110. The seal also provides the attachment point for the flexible liner 130 within the vessel body 110. The flexible liner 130 needs to be configured with adequate strength and thickness such that during filling with the gas 202 the liner 130 does not tear or break adjacent the stem 238. To obtain a hermetic seal, the stem 238 of the liner 130 is typically positioned over the external threads of the valve fitting 122. The fitting 122 is then threaded into the internal threads of the neck 116 of the vessel body 110. The flexible material in the liner stem 238 is thin enough to allow such threading to be accomplished but thick and tough enough to control cutting or tearing of the stem 238. During threading or joining, the stem 238 becomes compressed and is squeezed tightly into the spaces between the fitting 122 and neck 116, thereby creating an effective airtight seal for the vessel body 110. If desired, other sealing techniques can be used to provide a hermetic seal for the body vessel 110 alone or in combination with the seal shown in FIG. 2, such as O-rings, gaskets, heat sealing, chemical bonding, and the like that are known in the art and may include the use of a differing or additional material for the liner stem 238 to resist cutting and/or tearing.

FIG. 3 illustrates a cross section of the vessel body 110 of FIG. 2 in the charged or filled state. As shown, the flexible liner 130 is forced outward by the gas 202 (or fluid) at an elevated pressure. The flexible liner 130 continues to expand until its outer surface 234 mates substantially completely and contiguously with the inner surface 210 of the wall 114 (and other vessel components, such as the bottom plate 112 and neck 116 not shown in FIG. 3). In this manner, the liner 130 conforms to the shape and volume of the interior space or inner chamber of the vessel body 110. Significantly, the liner 130 does not have to be constructed to provide the structural strength to contain the pressurized gas 202 but instead this function is provided by the wall 114 (and other vessel body 110 parts) which is typically formed of a rigid material and mechanically strong material such as a metal, e.g., carbon steel and the like, with a thickness and selected based on the pressure rating of the vessel 110. As shown, the vessel wall 114 has an inner diameter, $ID_{Vessel}$, defined by the inner surfaces 210 of the wall 114, and the outer diameter, $OD_{Restrained\ Liner}$, of the flexible liner 130 is substantially equivalent to the vessel wall inner diameter when the pressurized liner 130 is restrained by the vessel wall 114. As shown, the inner volume of the vessel assembly 100 becomes substantially equivalent to the volume of the interior of the vessel body 110 less only the small volume of the liner 130 itself, which is defined by the thickness, $t_{LINER}$, of the liner 130. As the liner 130 does not restrain or contain the gas 202, the thickness, $t_{LINER}$, can be relatively thin and will depend upon the material used for the liner 130. For example, a foil-type liner 130 may be 0.3 mils or thicker while a liner 130 without a foil layer or without metalization may be 1 to 5 mils. The thickness of the liner 130 is not a limiting feature of the invention but will typically range between 0.05 and 2 millimeters. As noted previously, the thickness, $t_{LINER}$, may be reduced slightly upon addition of the elevated pressure gas 202. This is beneficial to the operation of the liner 130 as a hermetic seal because the material of the liner 130 becomes less stretched making it more difficult for gases to seep or leak through the liner 130, which is in direct contrast to a typical inflatable balloon or bladder that is unrestrained and that when filled with a higher pressure gas is more prone to leakage.

FIG. 4 illustrates one useful configuration for the flexible liner 130 for use in a vessel assembly 100 as shown in FIG. 1 in which the vessel body 110 is a cylinder. As shown, the liner 130 is fabricated generally to have an exterior surface 234 that takes the shape of the interior space or inner chamber of the vessel 100. Additionally, the insert 130 includes a stem 238 for mating with the neck 116 and valve fitting 122. The stem 238 is preferably long enough to mate with at least a few threads or a portion of the mating surfaces between these two components and more typically is as long as or longer than the mating surfaces between these two components. The shape and dimensions of the stem 238 of course will vary to match the inner configuration of the neck 116 and outer configuration of the valve fitting 122 (or of the sealing arrangement used in the particular vessel assembly 100, e.g., to support establishment of a hermetic seal at the inlet to the vessel body 110 regardless of the components used to control the supply and discharge of gas).

The illustrated flexible liner 130 is a foil balloon-type insert or a metalized flexible liner that is formed of a first and a second piece 402, 404 with a seal 406 formed between the pieces 402, 404. In some embodiments, the liner 130 is made of the two pieces 402, 404 that are formed from sandwiched sheets of plastic (such as polyethylene) and nylon (i.e., the inner layers) that are then coated with a metal (i.e., the outer or foil layer) which contacts the inner surface 210 of the vessel body 110. Typically, the metal is aluminum as this provides a low helium permeability characteristic, but many other metals may be utilized such as nickel, titanium, tungsten, gold, or other metals and alloys of such metals to provide a desired permeability for a particular gas 202 and/or to provide a desired material compatibility with the inner surfaces 210 of the vessel body 110. In some cases, the coating layer of the pieces 402, 404 is non-metallic with the important factor in material selection being a material that is dictated by or useful for providing compatibility with the product being contained within the liner 130. Further, in some embodiments, the liner 130 may be manufactured as a one-piece construction with a single flexible material or a composite flexible material. For example, due to the structural strength being provided by the vessel body 110, the liner 130 may in some cases be manufactured of latex or other elastic materials and provide adequate sealing between the gas 202 and the inner surfaces 210 of the vessel body 110 and provide adequate strength to avoid failure of the liner 130.

Importantly, the insert 130 in FIG. 4 is shown inflated with no exterior restraint. When the insert 130 is expanded without restraint its exterior surface 234 takes on a shape similar to the interior space or inner chamber of the vessel body 110. However, the outer diameter of the liner 130, $OD_{Unrestrained\ Liner}$, is at least as large as the inner diameter of the vessel, $ID_{Vessel}$, and more typically, is larger. As a result, the unrestrained volume of the liner 130 is greater than the inner volume of the vessel body 110. This is desirable to ensure that the liner 130 expands to fill the inner chamber of the vessel body 110, develops a contiguous and supporting contact (or sealing contact) with the inner surface 210 of the vessel body 110, and is not required to physically restrain the outward pushing gas (which would result in a failure in most cases of the liner 130).

FIG. 5 illustrates exemplary steps of a process 500 for fabricating, for filling, for using, and for reusing the pressure vessels of the present invention. As will become clear, the process 500 provides a number of advantages over prior gas storage processes including: minimizing material compatibility issues; allowing tailoring to meet customer requirements for storing various gases at varying purities and pressures while using the same or different exterior containers or vessel bodies; eliminating or at least managing particulate contamination caused by surface imperfections on inner surfaces of vessel bodies; eliminating the need to polish the inner surfaces of cylinders and other vessels; eliminating the need to vacuum bake an entire vessel body or gas cylinder; removing restrictions placed on pressure vessel service based on previously stored gases in the vessel; and providing a storage method the is compatible with existing pressure vessel bodies and with gas storage regulations (e.g., with DOT regulations and other regulations, codes, and laws).

The fill and use procedure 500 starts at 504 typically with an establishment of a set of design, use, and operating parameters. For example, these parameters may include establishing what gas is to be stored (such as helium, nitrogen, oxygen, and the like), determining a storage pressure, and deciding upon a storage volume (typically set at a particular temperature and pressure). With these and other parameters established, a particular pressure vessel assembly can be configured including selecting a vessel body (such as body 110 of FIG. 1), a gas source, and a valve assembly (such as valve 120 of FIG. 1). The vessel body selected may be a newly manufactured body (such as a standard compressed gas cylinder) and because the inner surfaces do not directly contact the stored gas, no rigid liner is required and polishing is not needed, which can significantly reduce costs. Alternatively, the vessel body may be a previously used container that is either lined or unlined and, significantly, inner surfaces of the vessel body do not have to be polished or repaired as the later inserted flexible liner provides the mating surface with the stored gas.

The process 500 continues at 510 with the selection of a flexible liner (such as liner 130) for insertion into the particular vessel body selected in step 504. Typically, the flexible liner is selected to have an unrestrained inflated shape that matches the inner chamber of the vessel body, or is at least generally similar, with dimensions that are at least as large as the inner chamber. As a result, the flexible liner is selected to have a volume that is at least as large as the volume of the vessel body defined by its inner surfaces and more preferably, at least slightly larger than the volume of the vessel body such that the flexible liner or insert does not provide the restraining forces for the stored gas. Further, as discussed previously, the flexible liner can have enhanced (or lower) gas permeability when the material of the liner is compressed or compacted.

The flexible liner is in some embodiments manufactured in a clean environment to minimize the risk of degrading the purity of the gas due to contaminants within the flexible liner or on its inner or contact surfaces. To further ensure gas purity, the inner surfaces of the flexible liner can be manufactured to have low surface roughness. As discussed above with reference to FIGS. 1–4, the liner can be manufactured of a single material (such as latex) or more typically, of composite materials and/or layers to better control gas permeability. For example, in one preferred embodiment, the liner is manufactured from sheets of a flexible or elastic material, such as a nylon blend (e.g., a blend of polyethylene and nylon or other materials with similar elasticity and strength characteristics), that is then metalized with a thin outer coating of a metal or a foil. The metal may be aluminum, nickel, titanium, tungsten, gold, or any other metal useful for providing a barrier to gas permeation. The materials used for inner or contact surfaces of the liner are preferably selected to be compatible with the gas intended to be filled into the liner and, when no foil layer is provided, to have low permeability for that gas. When a foil or outer layer is provided, the material for this layer is preferably selected because it exhibits low permeability to the gas, for its strength, and for its material compatibility with the inner surfaces of the vessel body.

Once the liner is manufactured and/or selected, the process 500 continues at 518 with insertion of the deflated (or not inflated) liner into the pressure vessel body. Depending on the configuration of the stem of the liner and of the neck (or gas inlet) of the vessel body, the stem may be stretched over the neck of the vessel body or otherwise clamped in place for later insertion of the valve. At 520, the fill and discharge valve are connected to the vessel body (such as at the threaded neck fitting) and, in most cases, to the stem of the flexible liner to obtain a hermetic seal between these three components. Additional components may be provided, such as O-rings, gaskets, mechanical fittings, and the like, to provide further assurance of obtaining and maintaining an acceptable seal for the vessel assembly.

At 530, a gas source or supply is connected to the valve installed in step 520. The pressure vessel assembly is then charged or filled with a gas (or in some embodiments a fluid) at an elevated pressure. During step 520, the flexible liner becomes inflated with the charging gas and expands until all or substantially all of its outer surface (such as the foil layer) contacts the inner surface of the vessel body. As the pressure increases within the liner, the liner further expands until its outer surface is substantially contiguously in contact with the inner surface of the vessel body, often to the point that small deformities and defects in the inner surface are filled by the liner. At this point of step 530, the vessel body is restraining any further expansion of the flexible liner and is providing the resisting forces to the contained, pressurized gas. Depending on the magnitude of the gas pressure, the thickness of the liner, and the material used for the liner, the liner may become compressed itself and its thickness may decrease (as measured before filling and after filling of the vessel).

After filling is completed, the process 500 continues at 540 with disconnecting the gas supply from the valve and placing the vessel in service. A system requiring the stored gas is connected to the valve, and the gas is discharged from the vessel assembly. During step 540, the flexible liner eventually begins to deflate when the gas pressure becomes relatively low and the liner pulls away from the inner surfaces of the vessel body. If the gas is fully discharged from the vessel assembly, the liner becomes fully deflated and is in a state similar to that at insertion during step 518. At 550, a decision is made as to whether the liner is to be reused. The decision at 550 may be made based on reuse of the vessel assembly for the same gas as filled in previously performed step 530 and based on the configuration of the liner (e.g., its thickness, its service life, and the like). If the liner is to be reused, the process 500 continues with the repeating of steps 530 to refill the vessel assembly and 540 to use the assembly again with the same liner.

More typically at 550 the decision will be made to not reuse the liner due to the low cost of the liners, the ease of replacing such liners, and the desire to better control gas purity degradation. In this case, the process 500 continues at 560 with the removal of the valve and liner from the pressure vessel body. The liner is simply thrown away and if the valve is to be reused, it may be prepared for use with a different gas (such as with cleaning to remove an potential impurities) or be sealed for storage and later reuse. At 570, a decision is made as to whether to reuse the vessel body. Due to the high strength of the vessel body, the decision is typically made at 570 to reuse the vessel body. The decision is also made to reuse the vessel body because with the use of the replaceable liners there is no need to clean or otherwise refurbish the vessel body prior to reuse. This is true even when the vessel body has been used previously with a gas that is incompatible with a later stored gas, i.e., reuse of a vessel body is not restricted by previously stored gases. If the vessel body or container is to be reused, the process 500 continues with the repeating of steps 510–570 (including deciding which gas to store in the vessel assembly, which is not limited by previous steps in process 500). If the container or vessel body is to be retired, the process 500 ends at 580.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. An apparatus for storing a fluid, comprising:

a vessel body including rigid walls with inner surfaces defining a chamber for storing the fluid and including an inlet for allowing a fluid to enter the chamber; and a liner formed of flexible material positioned within the chamber and connected to the inlet to receive the fluid entering the chamber, wherein the fluid received by the liner contacts an inner surface of the liner and forces the liner to expand until an outer surface of the liner contacts the inner surfaces of vessel body, whereby the vessel body provides resistive forces to contain the fluid;

wherein the liner comprises a contiguous sheet with the inner surface on a first side and the outer surface on a second side and wherein the inner surface of the sheet defines an inner volume of the liner, the inner volume in an unrestrained and inflated state being greater than about a volume of the vessel body chamber;

wherein the sheet is formed of a first layer including the inner surface formed of elastic material end a second layer abutting the first layer including the outer surface formed of material with low permeability to at least one gas; and wherein the second layer material comprises a metallic foil.

2. The apparatus of claim 1, wherein the fluid is a gas at an elevated pressure relative to a pressure exterior to the vessel body.

3. The apparatus of claim 1, wherein metallic foil is formed from a metal selected from the group consisting of aluminum, nickel, titanium, tungsten, and gold.

4. The apparatus of claim 1, further including a valve connected to the vessel body inlet at the connection between the inlet and the liner, wherein the liner includes a stem formed of elastic material positioned between the inlet and the valve, whereby a hermetic seal is obtained between the valve, the inlet, and the liner.

5. A pressure vessel for storing compressed gases, comprising:

a vessel body including a rigid wall enclosing an inner chamber and an inlet providing a passage to the inner chamber;

a valve assembly including a fitting connecting the valve assembly to the inlet of the vessel body; and a liner insert with a contiguous wall and stem having an inner surface and an outer surface, the liner insert being positioned within the inner chamber with the stem being interposed between the valve fitting and an inner surface of the inlet of the vessel body, and wherein the liner insert wall comprises a flexible material and the inner surface defines a deflated volume and an inflated volume, the deflated volume being less than a volume of the inner chamber and the inflated volume being at least as great as the volume of the inner chamber;

wherein the wall of the liner insert comprises a layer of elastic material including the inner surface and a layer of metallic material including the outer surface.

6. The pressure vessel of claim 5, wherein layer of metallic material is applied to the elastic layer using metalization and comprises a metal, or an alloy including a metal, selected from the group consisting of aluminum, nickel, titanium, tungsten, and gold.

7. The pressure vessel of claim 5, wherein the rigid wall is contiguous to form a cylinder and wherein the liner insert has a shape defined by the outer surfaces when the liner insert is inflated in an unrestrained state that is generally cylindrical, the diameter of the liner insert cylinder being greater than about the diameter of the rigid wall cylinder.

* * * * *